US007517443B2

(12) United States Patent
Paramonov et al.

(10) Patent No.: US 7,517,443 B2
(45) Date of Patent: Apr. 14, 2009

(54) TIN PLATING ELECTROLYTE COMPOSITION AND METHOD FOR ELECTROPLATING SURFACES WITH TIN

(75) Inventors: Vladimir Andreevic Paramonov, Moscow (RU); Vitalij Polikarpovic Vinogradov, Moscow (RU); Rafkat Spartakovic Takhautdinov, Magnitogorsk (RU); Angelo Frixione, Sant'Olcese (IT); Michele Turchetto, Cividale del Friuli (IT); Joseph Frimpong, Canfield, OH (US); Anatoliy Aleksandrovic Karpov, Magnitogorsk (RU); Galina Sergeevna Guljaeva, Moscow (RU)

(73) Assignee: Danieli & C. Officine Meccaniche S.p.A., Buttrio (IT)

( * ) Notice: Subject to any disclaimer, the term of this patent is extended or adjusted under 35 U.S.C. 154(b) by 0 days.

(21) Appl. No.: 10/593,924

(22) PCT Filed: Mar. 24, 2005

(86) PCT No.: PCT/EP2005/051390

§ 371 (c)(1), (2), (4) Date: Sep. 21, 2006

(87) PCT Pub. No.: WO2005/090646

PCT Pub. Date: Sep. 29, 2005

(65) Prior Publication Data

US 2007/0131559 A1 Jun. 14, 2007

(30) Foreign Application Priority Data

Mar. 24, 2004 (EP) ..... 04425208

(51) Int. Cl.

| | |
|---|---|
| ***C25D 3/32*** | (2006.01) |
| ***C25D 7/06*** | (2006.01) |
| ***C25D 5/36*** | (2006.01) |
| ***C25D 5/48*** | (2006.01) |
| ***C23C 16/00*** | (2006.01) |

(52) U.S. Cl. ..... 205/140; 205/154; 205/217; 205/220; 205/225; 205/226; 205/302; 106/1.25

(58) Field of Classification Search ..... 428/615; 205/140, 154, 217, 220, 225, 226, 302; 106/1.25
See application file for complete search history.

(56) References Cited

U.S. PATENT DOCUMENTS

| | | | | |
|---|---|---|---|---|
| 3,997,301 | A * | 12/1976 | Yoshihara et al. | 428/632 |
| 5,871,631 | A * | 2/1999 | Ichiba et al. | 205/302 |
| 6,322,686 | B1 * | 11/2001 | Brown et al. | 205/253 |
| 2003/0201188 | A1 | 10/2003 | Schetty, III et al. | |

FOREIGN PATENT DOCUMENTS

| | | |
|---|---|---|
| RU | 2103418 | 1/1998 |
| RU | 2103418 C1 * | 1/1998 |
| RU | 2114218 | 6/1998 |

OTHER PUBLICATIONS

Kalinin, "Improvement of Lubricity of Water-Containing Fluid Based on Proxamine 385", Ivanovo Chemical Technology Institute. Translated from Khimiya Teknologiya Topliv I Masel, No. 11, pp. 27-28, Nov. 1986, pp. 598-600. Abstract only.*

* cited by examiner

*Primary Examiner*—Edna Wong
(74) *Attorney, Agent, or Firm*—Stetina Brunda Garred & Brucker

(57) ABSTRACT

The invention refers to a composition and method of electrolytic tinning in continuous a steel strip or plate with an electrolyte composition comprising the following components (g/l): Tin (in a form of tin sulfamate) 50-90, Sulfamic acid, free 40-100, Sulfates, in a form of $SO_4^{2-}$ 0-15, Nitrogen-bearing block polymer 1-6, said block polymer being a copolymer of propylene oxide and ethylene oxide with molecular weight of 3950 to 6450 and "number of ethylene oxide links-to-number of propylene oxide links" ratio of 1.4-1.2:1.0 at initial buildup of required number of links from propylene oxide followed by oxyethylation.

7 Claims, No Drawings

TIN PLATING ELECTROLYTE COMPOSITION AND METHOD FOR ELECTROPLATING SURFACES WITH TIN

FIELD OF THE INVENTION

This invention provides a tin plating electrolyte composition. More particularly the invention relates to a method of electroplating in metallurgy that can be used for electroplating surfaces with tin.

BACKGROUND

A method of electroplating surfaces with tin that uses an electrolyte containing a phenolsulfonic acid and an addition agent of the ethoxylated naphthol sulfonic acid type is known and employed under the trade mark of "ferrostan".

The method includes steps of electrolytic degreasing (cleaning), electrolytic pickling, electrolytic tinning using the electrolyte containing (g/l):

| | |
|---|---|
| $Sn^{2+}$ | 28-34 |
| Free phenolsulfonic acid (in conversion to sulfuric acid) | 14-17 |
| "ENSA-6" agent | 3-6 |

reflowing, electrolytic passivation and oiling of tinplate.

The "ferrostan" technology provides for producing tin coating over a rather wide range of basic process parameters, but the presence of large quantities of phenol- and naphthol-containing products in the composition makes the process environmentally inappropriate.

A method for electrolytic tinning described in U.S. Pat. No. 6,217,738 provides the use of one or more acids obtained by modifying a sulfur acid (phenolsulfonic, toluenesulfonic, sulfamic, alkyl sulfonic etc.) and one or more addition agents that include di- and tri-substituted phenols with substituents comprising a secondary, tertiary or quaternary nitrogen atom. The disadvantages of the above method are the use of environmentally inappropriate products and complicated composition which in many cases includes a mixture of two acids and two addition agents making the application of this process in commercial tinplating lines highly difficult.

Another method for electrolytic tinning is also known and described in R.F. Pat. No SU1678094. This method provides the use of a sulfamic acid based electrolyte further containing polyethylene glycol sulfate and sulfosalicylic acid as addition agents. Extremely narrow limits of the process parameter variations and, especially, the electrolyte temperature make this process unsuitable for practical implementation. Moreover, the presence of the sulfosalicylic acid in the composition has bad effects on the environment that are an obstacle to its implementation.

Another method for electrolytically tinned plate production is disclosed in R.F. Pat. No RU2103418. Such document describes a method for coating a metal strip by using an electrolyte containing tin in form of bivalent ions, sulfamic acid and a nitrogen-bearing block copolymer of ethylene oxide. The current passes through the strip at densities of 20 to 70 A/dm$^2$. The electrolyte composition (g/l) is as follows:

| | |
|---|---|
| Tin in a form of bivalent ions | 20-37 |
| Sulfamic acid (total) | 100-140 |
| "Proxamin-385" | 0.5-2.5 |
| Water | the rest |

wherein the coating is applied at 20-70° C. and "proxamin-385" is used as the nitrogen-containing block copolymer of ethylene and propylene oxides.

The above process is distinguished by the environmental appropriateness since it doesn't provide the use of any high-hazard materials and is implemented within the wide range of process parameters (temperature, current density). The electrolyte possesses a high dissipating ability. But this electrolyte provides a high quality of coating only at current densities higher than 20 A/dm$^2$, while when producing electrolytic tinplate, the most-used, with coating weight of 1.0 to 2.0 g/m$^2$ per side, the required quality of the tin coating can be obtained only via several (at least two) passages that need the tin coating to be applied at densities of 8 to 17 A/dm$^2$ depending on the strip conveying speed in the line.

Moreover, the requirements on uniformity and corrosive resistance of coating become more rigid with decreasing the coating weight, which is not provided by the method under the above patent.

A problem found when using all the state of the art additives, such as Proxamin 385, is the control of foam that originates during recirculation of the electrolyte.

One of the aims of the present invention is to provide an electrolyte composition that permits to control such foam formation.

The nitrogen-containing block copolymers of ethylene and propylene oxides are known as addition agents in electrolytic deposition of tin (Pat. No RU2103418).

Such polymers are described in TU-6-36-0020 3335-95-94 FSUE "SRC NIOPIK", Moscow.

SUMMARY OF THE INVENTION

The object of the present invention is to develop a method of electrolytic tinning a metal strip or plate combining the environmental appropriateness, high quality of tin coating within the whole technically required and technologically grounded range of process parameters, the ease of operation and economic efficiency. This object is reached by selecting a specific class of nitrogen-containing block copolymers of ethylene and propylene oxides in combination with tin in form of tin sulfamate.

The technical result of this invention consists in widening the scope of process capabilities of the method including the manufacture of the strip (plate) with low-weight coating, provision of high quality of the tin coating and improvement of economic efficiency on maintenance of the environmental appropriateness.

Further objects will become evident by the following detailed description.

DETAILED DESCRIPTION OF THE INVENTION

The aforesaid technical result is achieved with the method according to the present invention. Said method of electrolytic tinning in continuous plates or strips is performed in an equipment operating at conveying speed of 2 to 11 m/s and comprises the steps of: (a) degreasing (cleaning), (b) pickling, (c) applying a tin coating using a sulfamic electrolyte comprising organic addition agents of the class of nitrogen-bearing block copolymers of propylene oxide and ethylene oxide at temperatures of 20 to 70° C. and current densities of 5 to 70 A/dm$^2$, (d) reflowing, (e) passivation and (f) oiling of tin coating. Such method is characterized in that the nitrogen-bearing block copolymer of propylene oxide and ethylene oxide is a polymer having molecular weight of 3950 to 6450 and "number of ethylene oxide links-to-number of propylene oxide links" ratio of 1.4-1.2:1.0 at initial buildup of required number of links from propylene oxide followed by oxyethylation.

The composition for electroplating surfaces according to the invention comprises (g/l):

| | |
|---|---|
| Tin (in a form of tin sulfamate) | 50-90; |
| Sulfamic acid, free | 40-100; |
| Sulfates, in form of $SO_4^{2-}$ | 0-15; |
| Nitrogen-bearing block copolymer of propylene oxide and ethylene oxide with the above mentioned characteristics | 1-6. |

Preferred surfaces obtainable according to the process of the invention have tin coatings weights ranging between 1.0-11.2 g/m$^2$. Typical coating weights for tinplate production are 1.10, 3.65 and 7.30 g/m$^2$, which correspond to tin thickness of about 0.15, 0.5 and 1.0 μm respectively.

The advantages of the composition according to the invention become evident by the following examples wherein a tin coated plate is produced according to the invention in comparison with RU2103418. Further characterization tests are furnished for comparison with products coated according to the "Ferrostan" process.

As evident by the examples:

the use of the above mentioned block copolymer as an addition agent to the electrolyte makes it possible to produce high-quality, easy-to-reflow tin coatings within the maximum range of process parameters, grounded technically and technologically, viz. at temperatures of 20 to 70° C. and current densities of 5 to 70 A/dm$^2$. Tests performed using a lab unit with rotating cathode at different temperatures and additive content in the electrolyte have indicated that minimum allowable current densities can be even of 5 A/dm$^2$.

the specific range of molecular weight selected for the addition agent simplifies its synthesis (reduction of mass and volume growth). A preferred block copolymer of the invention can be obtained via oxi-alkylation process applied to diethylenamine as starting compound to obtain the composition described here. The expert is able to perform the synthesis of the copolymer with the characteristics of the invention;

the maintenance of pH of the electrolyte in the specified limits, that is pH of 0.6 to 1.1 provides high electric conductivity of the electrolyte resulting in a lowering of energy consumption and at the same time reduces the tin hydrolysis rate and, consequently, decreases tin losses with sludge;

the electrolyte composition allows a tin coating deposition of equal or better homogeneity of the deposited tin as compared to the state of the art. In particular the problem of the "edge effect" is reduced, that is, the amount of tin overcoating at the edges of the strip or plate is lowered; this allows: to reduce the amount of tin in the deposition thus reducing production costs and to avoid damages to the strip or coating during subsequent handling of the same, for instance during the coiling the more uniform coating thickness allows to highly reduce the risks of breaking the coating and/or the strip itself. This feature can be ascertained by measuring the tin thickness at the edges of the strip or plate as edges overcoating;

the electrolyte composition allows a better or at least equal fluidity of the tin deposited layer that improves the final aspect of the re-melted surface of tin layer; this feature can be ascertained by evaluating the coating defects that can appear during the electrolytic tinning. Defects can be: dullness, "tin drops", "tin strokes", small hollows, sludge, "non-reflowed edge";

the electrolyte composition allows the production of a deposited tin layer of equal or lower porosity as compared to the state of the art method. This feature can be ascertained by evaluating the "relative porosity"; such parameter is widely recognized as fundamental in assessing the good performances of a tin coating. Low porosity values are an index of a compact coating and thus increased corrosion resistance and longer working life.

By summing up, the advantages of the composition and process according to the invention result in: absence of toxic compounds, such as phenol- and naphthol-containing products, for example phenolsulfonic acid and ENSA (ethoxylated alpha-naphtol sulfonic acid, utilized as additive), absence of volatile components, high uniformity of coating distribution, reduction of edges overcoating, improvement of corrosion resistance, drastic reduction of some coating defects, reduction of tin consumption and, in particular, reduction of foams.

Reduced foam levels result in better control of acid misting, in improved working environment and in evident reducing of porosity of tin coating According to the invention, the method for electrotinning a surface in the form of a steel strip or plate by using continuous electrolytic tinning equipment is characterized by the use of the composition as mentioned in the above.

The expert in the field, by reading the present description, is in condition to perform the invention.

The present invention will be illustrated by the following examples that are not to be considered as limiting the scope therein.

EXAMPLE 1

In a continuous electrolytic tinning line with conveying speed of 7.5 m/s, on a pre-cleaned and pre-pickled (according for instance to the "Ferrostan" process) strip of low-carbon steel (of the type indicated in EN 10202 ed. 2001) it is electrolytically applied a tin coating 5.6 g/m$^2$ by weight per side under the conditions specified below; then the coating is reflowed, passivated and oiled (according to EN 10202 ed. 2001). The coating produced is bright, without dullness and differences in tone and characterized by high uniformity of distribution and corrosion resistance.

The electrolyte used has the following composition (g/l):

| | |
|---|---|
| Tin, in a form of tin sulfamate | 80 |
| Sulfamic acid, free | 90 |
| Sulfates, in a form of $SO_4^{2-}$ | 10 |
| Nitrogen-containing block copolymer of propylene oxide and ethylene oxide with molecular weight of 5000 and "number | 4 |

-continued

| | |
|---|---|
| of ethylene oxide links-to-number of propylene oxide links" ratio 1.3:1.0 | |
| Electrolysis parameters: | |
| pH | 0.6 |
| Temperature | 60° C. |
| Current density | 50 A/dm$^2$ |

EXAMPLE 2

In a continuous electrolytic tinning line with conveying speed of 4.0 m/s, on the pre-cleaned and pre-pickled strip of Example 1 it is electrolytically applied a tin coating 1.4 g/m$^2$ by weight per side under the conditions specified below; then the coating is reflowed, passivated and oiled (according to EN10202 ed. 2001). The coating produced is bright, without dullness and differences in tone and characterized by high uniformity of distribution and corrosion resistance The electrolyte used has the following composition (g/l):

| | |
|---|---|
| Tin, in a form of tin sulfamate | 55 |
| Sulfamic acid, free | 50 |
| Sulfates, in a form of $SO_4^{2-}$ | 0 |
| Nitrogen-containing block copolymer of propylene oxide and ethylene oxide with molecular weight of 6000 and "number of ethylene oxide links-to-number of propylene oxide links" ratio 1.4:1.0 | 2 |
| Electrolysis parameters: | |
| pH | 1.0 |
| Temperature | 30° C. |
| Current density | 10 A/dm$^2$ |

EXAMPLE 3

Comparison

In this example the Proxamine 385 described in Pat. No RU2103418 is used.

In a continuous electrolytic tinning line with conveying speed of 6.0 m/s, on the pre-cleaned and pre-pickled strip of Example 1 it is electrolytically applied a tin coating 1.4 g/m$^2$ by weight per side under the conditions specified below; then the coating is reflowed, passivated and oiled (according to EN10202 ed. 2001). The coating produced is matte, differs in tone, corrosion resistance is low.

The electrolyte composition (g/l):

| | |
|---|---|
| Tin, in a form of tin sulfamate (in conversion to $Sn^{2+}$ 25), | 65 |
| Sulfamic acid, free | 60 (total - 100) |
| Sulfates, in a form of $SO_4^{2-}$ | 5 |
| Nitrogen-containing block copolymer of propylene oxide and ethylene oxide with molecular weight of 7600 ("proxamin-385") | 1 |
| Electrolysis parameters: | |
| Temperature | 40° C. |
| Current density | 25 A/dm$^2$ |

EXAMPLE 4

Characterisation Tests

Table 1 shows the results of characterisation tests performed on a tin plate produced according to the process of the invention in comparison with the coating obtained according to the "Ferrostan" process. The tests refer to coating thickness of 0.5 μm-(3.65 g/m$^2$, also commonly known as "average coating weight") and the parameters are shown in the following table.

TABLE 1 characteristics of the tin coating 0.5 μm thick
TIN PLATE PARAMETERS COMPARISON

| Parameter | Process of the invention | Ferrostan Process | Notes |
|---|---|---|---|
| "Relative porosity" | 0.06 [%] | 0.09 [%] | For 0.5 μm Tin Coating thickness |
| Edges Overcoating | 12.0 [%] | 25.0 [%] | At edge distance of 10 mm |
| Surface Quality | 1.6 [%] | 2.0 [%] | Only considering process defects |

Test for "Relative Porosity" of Tin Coating

This test is based on the determination of the iron dissolution rate from the surface of black, or tin, plate (in latter case through freckles, noncontinuities, coating defects).

To perform this test, a special solution has been developed. At the anodic tinplate sample polarization from stationary potential, the above solution conforms to the following conditions:

- iron transition from the active dissolution region to the passive one;
- maintenance of tin passivity over the whole range of potentials during testing;
- maintenance of chromatic films passivity over the whole range of potentials during testing.

The solution was formulated as follows:

| | |
|---|---|
| Sodium acetate | 27.2 g/L |
| Sodium chloride (5%) | 1.4 mL |
| Acetic acid (glacial) | 2.0 mL |
| pH | 5.65 |
| temperature | 20-25° C. |

Test Procedure

A sample of tin, or black, plate is placed into the above-described solution and kept in it over a period of time necessary for setting the stationary potential. The potential value for black plate is −600÷−700 mV relative to a silver-chloride electrode while for electrolytic tinplate this value is −400÷−600 mV. But sometimes tinplate with the passive film and especially after long-term storage needs cathodic surface treatment at the potential of −700 mV for 1-5 s.

Once the stationary potential has been set, the anodic potentiodynamic is polarization curve with the sweep rate of 2 mV/s is taken. The current value is recorded in the curve maximum region at potentials of −300÷−350 mV (depending on ohmic component).

By the tinplate "relative porosity" is meant a ratio of the passivation current value of the tinplate sample (i) to the passivation current value of the black plate sample (l), which the tinplate is made from. Determination of l is allowed upon the coating removal from the tinplate sample.

The measurement result expressed in percent is called the factor of porosity (K).

$$K(\%)=i/l\times 100.$$

This method is of particular convenience in cases when coatings of different thickness and deposition modes are applied to the similar steel substrate. The method correlates adequately with the results of porosity evaluation by "the iron transition" (ASTM 623, method No 4 for K-type tinplate) and "sulfide corrosion" in the damp atmosphere of sulfurous gas.

A comparison of the porosity level in the phenolsulfonic (Ferrostan process) and sulfamic (according to the invention) electrolyte shows that the porosity of coating reduces in passing from the phenolsulfonic electrolyte to the sulfamic one.

Test for Edges Overcoating

Data in Tab. 1 have been obtained as follows. Given a desired value of the coating weight to be applied on the strip (in this case 3.65 g/m$^2$) the tin thickening is evaluated at a distance of 10 mm from the edge of said strip with respect to the average coating weight value measured (for example according to method described in EN 10202 ed. 2001) for the remaining width of the strip. In this case the edges overcoating is 12% for the process according to the invention (tin coating weight of 4.088 g/m$^2$ at the edges of the strip) with respect to a value that is much higher (25%) when the "Ferrostan" process is applied.

Test for Surface Quality

The surface quality of the products was evaluated by identifying defects (dullness; "tin drops"; "tin strokes"; small hollows; sludge; "non-reflowed edge"; anodic line) which would lead to a rejection of the interested part of the strip. In our case we rejected only 1.6% of the material. By contrast the "Ferrostan" process have a maximum yield of 98%. Taking into account that a plant for tinning strips or plates has a productivity of about 100,000 tons per year, the above difference means that the process according to the invention provides about 400 tons per year of product saved.

The invention claimed is:

1. A composition to be used in a process for electroplating surfaces with tin, said composition comprising the following components (g/l):

| | |
|---|---|
| Tin (in a form of tin sulfamate) | 50-90 |
| Sulfamic acid, free | 40-100 |
| Sulfates, in a form of $SO_4^{2-}$ | 0-15 |
| Nitrogen-bearing block copolymer of propylene oxide and ethylene oxide | 1-6 |

said copolymer having a molecular weight of 3950 to 6450, said copolymer further having a number of ethylene oxide links-to-number of propylene oxide links ratio of 1.4-1.2:1.0 at initial buildup of required number of links from propylene oxide followed by oxyethylation, the composition having a pH of 0.6 to 1.1.

2. Method for electrotinning a surface in form of a steel strip or plate, the method comprising:

electrolytically coating the surface in the presence of the composition according to claim 1.

3. Method according to claim 2 performed in continuous electrotinning lines with the steel strip conveying at a speed of 2 to 11 m/s.

4. Method according to claim 2 performed at temperatures of 20 to 70° C.

5. Method according to claim 2 performed at current densities of 5 to 70 A/dm$^2$.

6. Method according to claim 2 in which the strip or plate is subjected to a pretreatment of degreasing and pickling.

7. Method according to claim 2 in which the strip or plate is subjected to a post-treatment of reflowing, passivation and oiling of a tin coating.

* * * * *